US010022731B2

(12) United States Patent
Monesmith et al.

(10) Patent No.: US 10,022,731 B2
(45) Date of Patent: Jul. 17, 2018

(54) CENTRIFUGE VESSELS WITH A CENTER MOUND AND AN INTERNAL ELONGATE TUBE SUITABLE FOR LIVE CELL PROCESSING AND ASSOCIATED SYSTEMS AND METHODS

(71) Applicant: Argos Therapeutics, Inc., Durham, NC (US)

(72) Inventors: Tamara Tatroe Monesmith, Durham, NC (US); Arjun V. Caprihan, Donvale (AU); Christopher Thomas Ryan, East Brunswick (AU); Richard A. Grant, St. Kilda West (AU); Ian S. Fitzpatrick, Elwood (AU); Christopher John Leigh-Lancaster, Murrumbeena (AU)

(73) Assignee: Argos Therapeutics, Inc., Durham, NC (US)

( * ) Notice: Subject to any disclaimer, the term of this patent is extended or adjusted under 35 U.S.C. 154(b) by 382 days.

(21) Appl. No.: 14/372,944

(22) PCT Filed: Jan. 22, 2013

(86) PCT No.: PCT/US2013/022512
§ 371 (c)(1),
(2) Date: Jul. 17, 2014

(87) PCT Pub. No.: WO2013/116041
PCT Pub. Date: Aug. 8, 2013

(65) Prior Publication Data

US 2014/0364296 A1 Dec. 11, 2014

Related U.S. Application Data

(60) Provisional application No. 61/592,759, filed on Jan. 31, 2012.

(51) Int. Cl.
*B04B 7/08* (2006.01)
*B01L 3/00* (2006.01)
*B04B 13/00* (2006.01)

(52) U.S. Cl.
CPC ..... *B04B 7/08* (2013.01); *B01L 3/5021* (2013.01); *B04B 13/00* (2013.01);
(Continued)

(58) Field of Classification Search
CPC ..... B01L 3/5021; B01L 2200/026; B01L 2300/046; B01L 2300/0832; B01L 2300/048; B04B 13/00; B04B 7/08
(Continued)

(56) References Cited

U.S. PATENT DOCUMENTS 4,927,749 A 5/1990 Dorn
4,961,724 A 10/1990 Pace
(Continued)

FOREIGN PATENT DOCUMENTS

EP 1 057 534 A1 12/2000
WO WO 2005049168 A2 * 6/2005 ..... A01N 1/02

OTHER PUBLICATIONS

International Search Report for corresponding PCT application No. PCT/US2013/022512, 3 pages, dated May 15, 2013.
(Continued)

*Primary Examiner* — Walter Dean Griffin
*Assistant Examiner* — Shuyi S. Liu
(74) *Attorney, Agent, or Firm* — Myers Bigel, P.A.

(57) ABSTRACT

Centrifuge vessels suitable for live cell processing include a bowl with a cap, and a tube inside the bowl extending between the cap and a lower portion of the bowl. The bottom of the bowl can have a closed annular ring surrounding a
(Continued)

center mound. The vessels can be particularly suitable for processing low volumes of live cells for vaccines or other therapies.

21 Claims, 13 Drawing Sheets

(52) U.S. Cl.
CPC ... *B01L 2200/026* (2013.01); *B01L 2300/046* (2013.01); *B01L 2300/048* (2013.01); *B01L 2300/0832* (2013.01)

(58) Field of Classification Search
USPC ..... 494/11, 37, 43, 47
See application file for complete search history.

(56) References Cited

U.S. PATENT DOCUMENTS 4,983,158 A 1/1991 Headley
5,271,852 A * 12/1993 Luoma, II ..... B01L 3/50215 210/516
5,474,687 A 12/1995 Van Vlasselaer
5,770,073 A * 6/1998 Bach ..... A61M 1/3627 210/436
5,928,125 A 7/1999 Ding et al.
6,197,579 B1 * 3/2001 Van Vlasselaer ..... B01L 3/5021 210/781
6,660,228 B1 * 12/2003 Chang ..... B01J 19/0093 356/246
7,438,462 B1 * 10/2008 Bodie ..... B01F 11/0028 366/197
7,694,828 B2 * 4/2010 Swift ..... B01D 17/10 210/173
8,322,539 B1 * 12/2012 Ellis ..... B01L 3/502 210/416.1
8,337,711 B2 12/2012 Dorian et al.
2010/0140182 A1 * 6/2010 Chapman ..... A61M 1/029 210/741
2010/0268148 A1 * 10/2010 Wendler ..... A61M 1/3627 604/6.09
2011/0028296 A1 2/2011 Zonneveld et al.
2013/0116102 A1 * 5/2013 Hansen ..... B04B 11/043 494/10

OTHER PUBLICATIONS

DACS™ SC Product Brochure, Part No. 9091001, PN Rev. Date Jul. 13, 1999, 10 pages.
International Preliminary Report on Patentability Corresponding to International Application No. PCT/US2013/022512; dated Aug. 14, 2014; 7 pages.
U.S. Department of Health and Human Services Food and Drug Administration, Guidance for Industry, Sterile Drug Products Produced by Aseptic Processing—Current Good Manufacturing Practice, Sep. 2004, Pharmaceutical CGMPs, 63 pages.

* cited by examiner

% VIABLE CELLS IN WASTE (i.e., REMOVED WITH SUPERNATANT USING A CENTRAL TUBE)

| EXPERIMENT # | PREPARING CELLS FOR FREEZING USING VESSEL | THAWING CELLS AND PREPARING FOR CULTURE USING VESSEL |
|---|---|---|
| 1 | 2.2% | 1.2% |
| 2 | N/A | N/A |
| 3 | N/A | 1.5% |
| 4 | N/A | 1.1% |
| 5 | N/A | 0.7% |
| 6 | 4.2% | N/A |
| 7 | 5.4% | N/A |
| 8 | 2.4% | N/A |
| 9 | 2.7% | N/A |
| 10 | 2.7% | 1.2% |
| 11 | 3.9% | 1.2% |
| 12 | 2.6% | 2.2% |
| 13 | 3.2% | N/A |
| 14 | N/A | 2.1% |
| 15 | 3.0% | 0.9% |
| 16 | 3.0% | 1.0% |
| 17 | 4.2% | N/A |
| 18 | 4.0% | 0.3% |
| 19 | 2.4% | 2.7% |
| 20 | 4.1% | 13.2% |
| 21 | 2.5% | 4.5% |
| 22 | 2.9% | ND |
| 23 | 2.6% | 2.4% |
| 24 | 7.1% | N/A |
| | | |
| N | 19 | 15 |
| MEAN | 3.4% | 2.4% |
| SD | 1.2% | 3.2% |

FIG. 16

CENTRIFUGE VESSELS WITH A CENTER MOUND AND AN INTERNAL ELONGATE TUBE SUITABLE FOR LIVE CELL PROCESSING AND ASSOCIATED SYSTEMS AND METHODS

RELATED APPLICATIONS

This application is a 35 USC 371 national phase application of PCT/US2013/022512, filed Jan. 22, 2013, which claims the benefit of and priority to U.S. Provisional Patent Application Ser. No. 61/592,759 filed Jan. 31, 2012, the contents of which are hereby incorporated by reference as if recited in full herein.

FIELD OF THE INVENTION

This invention relates to centrifuge vessels for live cell processing.

BACKGROUND OF THE INVENTION

Centrifugation of target material using a centrifuge vessel holding the target material for processing is widely used in biologic laboratory operations. In some cases, the material of interest remains in fluid in the vessel, allowing it to be decanted from the vessel while leaving behind fluid residue. On other occasions, the target material of interest is centrifuged to a pellet form. The fluid component or supernatant can be removed, leaving the target material of interest in the vessel. If the target material comprises live cells, the pellet method can be used to concentrate the cells to a smaller volume and/or to wash the cells of one suspension media and replace it with a different suspension media.

When processing live cells for clinical or therapeutic use, it can be desirable to process the live cells within one or more closed vessels and reduce, if not minimize, the stress and/or distress experienced by the cell population. Closed vessels allow the processing to proceed in a lower grade clean room than would otherwise be needed for open processing. To minimize stress, the processing can be less aggressive. In particular, the methods of cell concentration and washing may rely on the integrity of a cell pellet at the bottom of the centrifuge vessel to avoid cell losses when the supernatant is removed. While the cells may be stressed by the process of pellet creation, they can also be further stressed or distressed by the action of re-suspending the pellet. The processing can be particularly difficult when the cells in question are present in a limited number. The compromise between pellet integrity and re-suspension vigor are typically conflicting requirements.

SUMMARY OF EMBODIMENTS OF THE INVENTION

Embodiments of the invention provide centrifuge vessels and bowls that are particularly suitable for processing biologic materials including, for example, live cells for vaccine or other cell-based therapeutic medicament manufacture.

Embodiments of the invention are directed to centrifuge vessels. The vessels can include a bowl having a bottom portion and a top and a cap configured to attach to the bowl defining an enclosed interior chamber. The bowl bottom portion has downwardly extending sidewalls that merge into a closed bottom, the closed bottom having an annular surface surrounding a center mound. The cap includes a plurality of spaced apart, upwardly extending fluid ports, one residing proximate a center of the cap. The vessel also includes an elongate tube with a length having opposing top and bottom portions and an open flow channel extending therethrough. The tube is held upright and encased inside the interior chamber with the bottom portion proximate the center mound in the bottom of the bowl and the top portion attached to the cap in fluid communication with the fluid port proximate the center of the cap.

The cap can include tubing retainer brackets extending upwardly thereon.

The vessel can include a tube enclosure cap attached to the vessel cap. The tube enclosure cap can be configured to enclose a plurality of tube tails wrapped a plurality of times about the brackets therein.

The vessel cap can include an internal decanting surface with a concave shape that resides proximate an outer perimeter portion of the cap adjacent at least one of the fluid ports.

The vessel cap can include a ledge extending about a lower perimeter portion thereof. The ledge can have a profile with a downwardly extending ridge portion that is integrally attached to a channel that extends about an upper end of the bowl.

The center mound can include at least one shoulder that defines a stop for the tube so that the bottom of the tube resides proximate but a defined distance above the closed bottom of the bowl.

The center mound can include an upwardly projecting tang that extends a distance into the bottom of the tube.

The center mound can define a flow surface that tapers down to the closed floor from the shoulder.

The bowl can have a monolithic injection molded body. The center mound can include at least one shoulder and a flow clearance surface that tapers down toward the closed bottom from the shoulder to allow fluid to be extracted from the vessel through the tube during use.

The vessel can be used in combination with a holder having a vessel cradle and a base. The holder vessel cradle releasably engages the vessel and is attached to a shaker device that rotates the vessel through a defined sequence of movement. The sequence of movement has rotational motions that are less than 360 degrees.

After vibrating and/or shaking the vessel for a defined time and/or after a sequence of movement carried out by the shaker device, the holder while held by the shaker device is configured to hold the vessel in a decant orientation whereby the vessel is tilted to be partially inverted.

The vessel can define a functionally closed sterile processing system and can include live cells (for processing) therein. The cap can have a perimeter portion with a circumferentially extending ledge that is ultrasonically welded to an upper end of the bowl to define a fluid-tight perimeter such that fluid can enter and/or exit only through the fluid ports (in the cap).

Other embodiments are directed to centrifuge bowls having a top and bottom portion. The bottom portion has downwardly extending sidewalls that taper inward to a lower closed bottom surface. The bottom surface includes an annular portion with a concave shape that faces upward, the annular portion surrounding a center mound with a closed surface. The center mound has at least one downwardly sloped flow clearance surface that extends from a top portion of the mound toward the closed bottom surface of the bowl. The sidewalls have outwardly extending orientation and/or locking members that are circumferentially spaced apart. The bowl has a monolithic injection molded body.

The center mound can have a pair of flat shoulder ledges on opposing sides of an upwardly projecting tang. The center mound can have a downwardly sloped flow clearance surface that extends from a bottom of the tang proximate the shoulders down.

The top portion of the bowl includes a perimeter wall with a circumferentially extending channel with an opening that faces up.

Still other embodiments are directed to methods of processing live cells. The methods include: (a) providing a centrifuge vessel with a cap attached to a bowl, the vessel defining a sterile internal chamber, the bowl having a closed bottom with an annular portion having a concave shape that faces inward, the vessel comprising live cells for processing; (b) centrifuging the live cells in the vessel; and (c) capturing the live cells as a pellet in an annular shape in the bottom of the bowl.

The methods can include attaching ends of flexible conduit to respective fluid portions on the cap so that the conduits have free tails, then wrapping the conduit tails about brackets on the cap before the centrifuging step.

The methods can include unwrapping the conduit tails and connecting the tails to target devices after the centrifuging step.

The live cells can comprise blood cells of any type, including but not limited to, red blood cells, monocytes, dendritic cells, T cells, B cells, granulocytes, macrophages and stem cells such as mesenchymal stem cells.

The capturing step can be carried out to capture the cells in a soft pellet.

The methods can further include, after capturing the live cells as a soft pellet; (d) removing supernatant in the vessel through a central tube in fluid communication with a fluid port on the cap (e) mounting the vessel to an automated shaker; (f) electronically directing the automated shaker to carry out a defined sequence of movement; and (g) redistributing or resuspending the live cells in the soft pellet in response to the directing step to thereby vibrate, shake and/or mix the cells using the automated shaker.

The mounting can be carried out using a mechanical holder that is attached to the shaker, the holder having a vessel cradle that releasably engages the vessel. The method can further include electronically directing the shaker to stop at a position that causes the holder to tilt the vessel to a partially inverted position, then decanting fluid in the vessel through at least one fluid port into respective flexible conduit.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

Other systems and/or methods according to embodiments of the invention will be or become apparent to one with skill in the art upon review of the following drawings and detailed description. It is intended that all such additional systems, methods, and/or devices be included within this description, be within the scope of the present invention, and be protected by the accompanying claims.

BRIEF DESCRIPTION OF THE DRAWINGS

Other features of the present invention will be more readily understood from the following detailed description of exemplary embodiments thereof when read in conjunction with the accompanying drawings.

FIG. 11A illustrates the two components before attachment and FIG. 11B illustrates the two components after attachment according to some embodiments of the present invention.

FIG. 16 is a table of percent (%) viable cells in waste (i.e., removed with supernatant using central tube) according to two different procedures using vessels according to some embodiments of the present invention.

DETAILED DESCRIPTION OF EMBODIMENTS OF THE INVENTION

Figure 2:
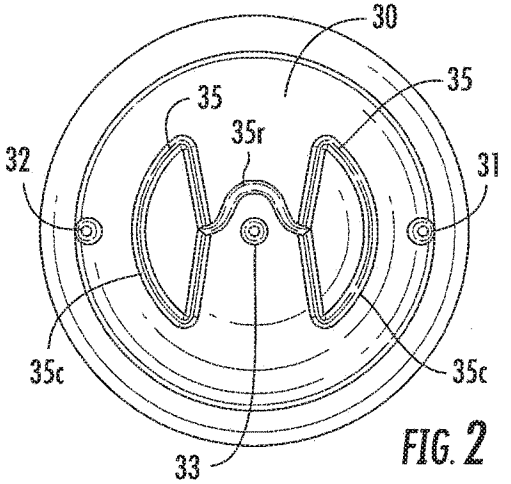
FIG. 2 is an exemplary top view of the device shown in FIG. 1A according to some embodiments of the present invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise. One or more features shown and discussed with respect to one embodiment may be included in another embodiment even if not explicitly described or shown with another embodiment.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention. The sequence of operations (or steps) is not limited to the order presented in the claims or figures unless specifically indicated otherwise.

The term "about" means that the stated parameter can vary between +/−20% of the stated number and in some embodiments can vary less, typically between +/−10% of the stated number.

The term "functionally closed capability" refers to systems that are isolated from the external environment to allow for sterile processing.

Embodiments of the invention are directed to vessels for processing biologic material such as live cells.

The term "soft pellet" refers to a group of cells that are loosely packed together which can be dispersed into a cell suspension in response to agitation or mixing.

Figure 3:
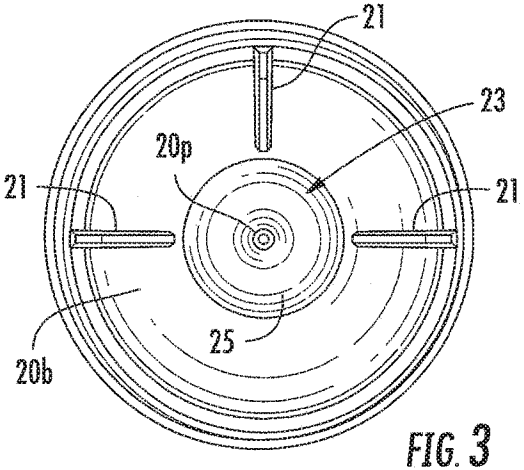
FIG. 3 is a bottom view of the device shown in FIG. 1A according to some embodiments of the present invention.
Figure 1B:
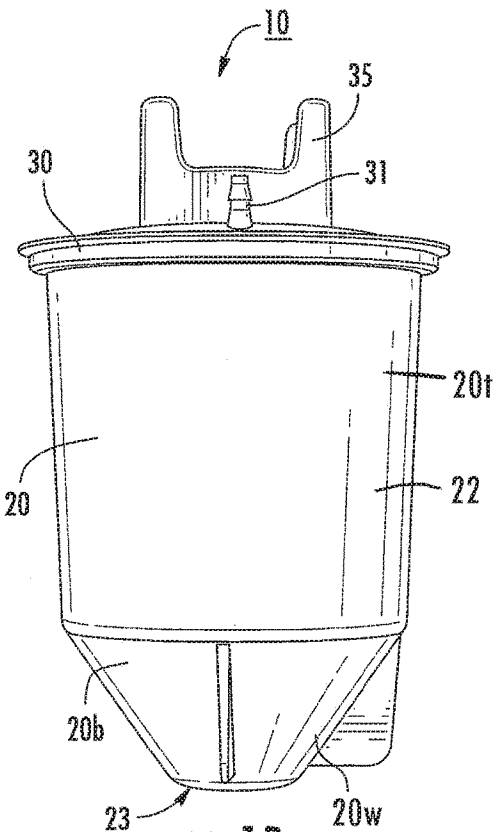
FIG. 1B is a side view of the device shown in FIG. 1A.
Figure 1A:
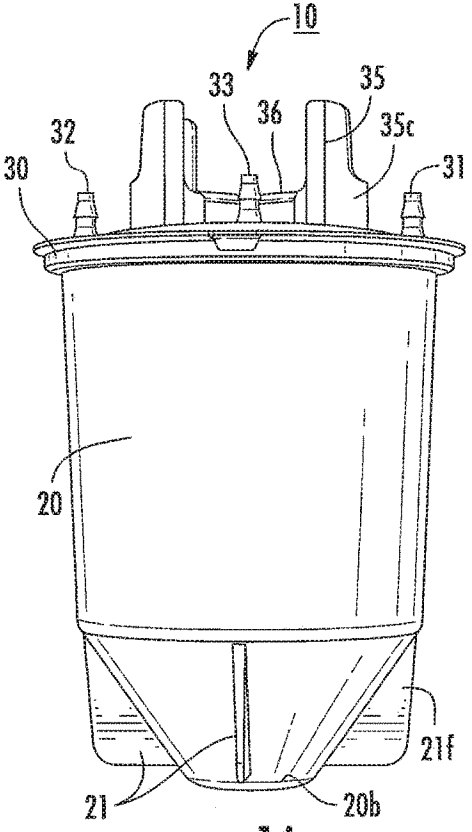
FIG. 1A is a front view of an exemplary centrifugation vessel according to embodiments of the present invention.

Turning now to the figures, FIGS. 1A and 1B illustrate a vessel 10 with a bowl 20 and a cap 30 attached thereto. The bowl 20 has a bottom portion 20*b*. The bottom portion 20*b* can include external orientation members 21 that cooperate with a vessel holder 100 (FIG. 13A) to facilitate proper orientation and/or locking engagement with that device. As shown, the orientation members 21 are flat, radially-extending, circumferentially spaced apart fins 21*f*. The members 21 are shown as three members, spaced apart about 90 degrees, with one larger outer wall segment devoid of a member, the larger segment spanning about 180 degrees as shown in FIG. 3. However, other configurations of the orientation/locking members may be used and the bowl 20 may not include any of the external orientation features 21.

The bowl 20 can be a single-piece injection molded member, typically a monolithic molded body of a substantially rigid material. The molding injection point 20*p* (FIG. 6) can be at the bottom of the bowl 23 underlying the mound 26. Suitable moldable materials include thermoplastic polymers such as polycarbonates and polypropylenes. An example of a suitable moldable material is USP Class VI polycarbonate which can be sterilized as is known to those of skill in the art using, for example, steam at about 120° C., gamma radiation or ethylene oxide (EtO).

The bowls 20 can define a centrifuge bowl volume of from about 1 or more milliliters to multiple liters, depending on the process and type of cells being processed. In some embodiments, the vessels 10 have small bowl volumes of between about 1-50 ml, such as about 2 ml, about 3 ml, about 4 ml, about 5 ml, about 6 ml, about 7 ml, about 9 ml, about 10 ml, about 11 ml, about 12 ml, about 13 ml, about 14 ml, about 15 ml, about 16 ml, about 17 ml, about 18 ml, about 19 ml, about 20 ml, or between about 20-30 ml, about 30-40 ml, or about 40-50 ml. In other embodiments, the vessels have bowl volumes of between about 50 ml to about 100 ml, including between about 50-60 ml, about 60-70 ml, about 80-90 ml and between about 90-100 ml. In some embodiments, the bowls have volumes of between about 100 ml to about 900 ml, while in yet other embodiments the bowls have volumes of between about 1 liter to about 10 liters.

Figure 13B:
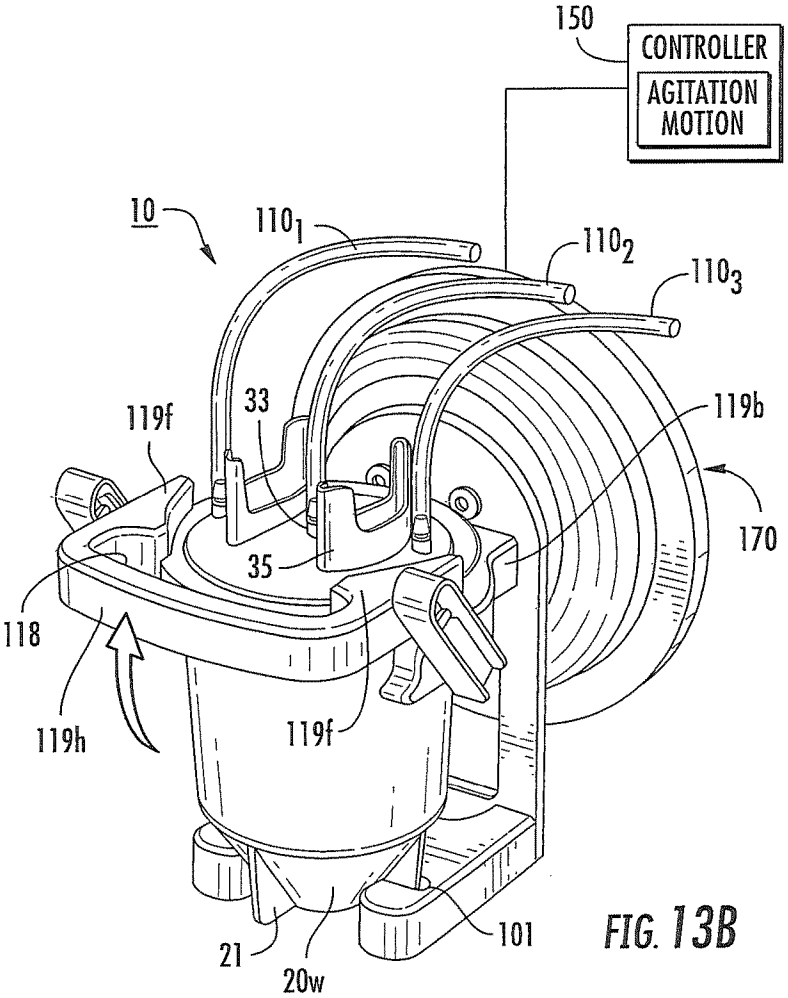
FIG. 13B is a front side perspective view of the vessel in the vessel holder shown in FIG. 13A with the vessel holder handle attached to the vessel according to embodiments of the present invention.
Figure 13A:
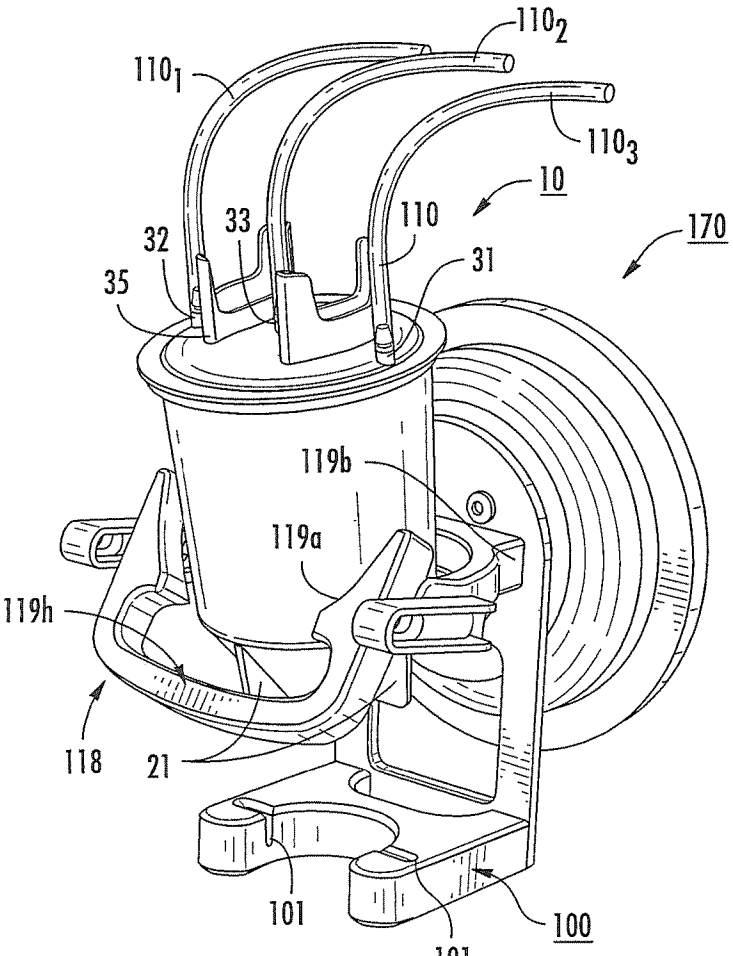
FIG. 13A is a front side perspective view of a vessel, such as that shown in FIG. 1A, with tubing attached thereto, positioned for placement in a vessel holder attached to a shaker device according to embodiments of the present invention.

FIGS. 1A, 1B and 2 illustrate that the cap 30 can include a plurality of fluid ports 31, 32, 33 typically configured as hose barbs, for engaging conduit 110 (FIG. 13A). The fluid ports 31, 32, 33 can be substantially in-line. The ports 31, 32, 33 can be arranged with two diametrically opposing outer ports 31, 32 and at least one substantially center port 33 that can reside proximate a center of the cap 30, between the outer ports 31, 32 as shown in FIG. 2.

Figure 12C:
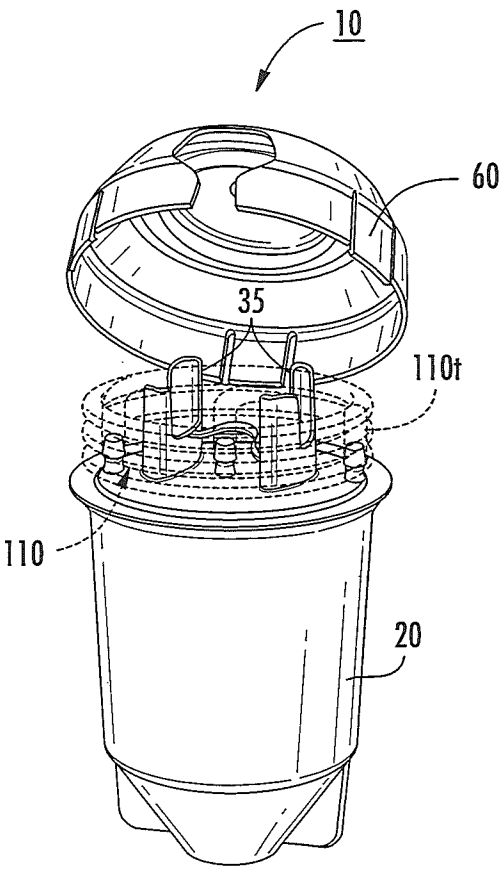
FIGS. 12A-12C are perspective views illustrating the vessel shown in FIG. 1A with tubing held on a top portion thereof under a retainer cap according to embodiments of the present invention.
Figure 12B:
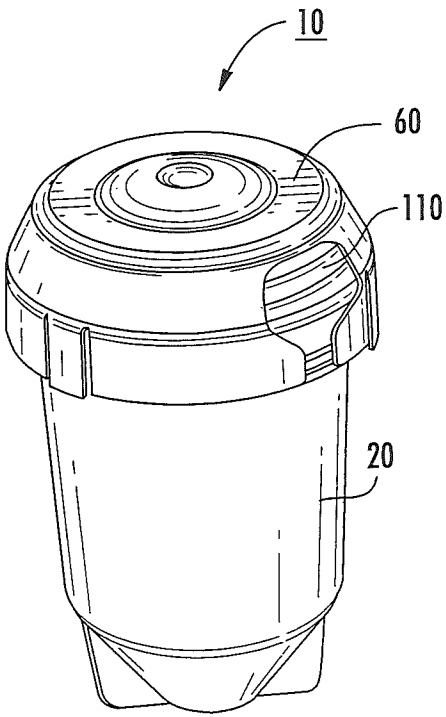
Figure 12A:
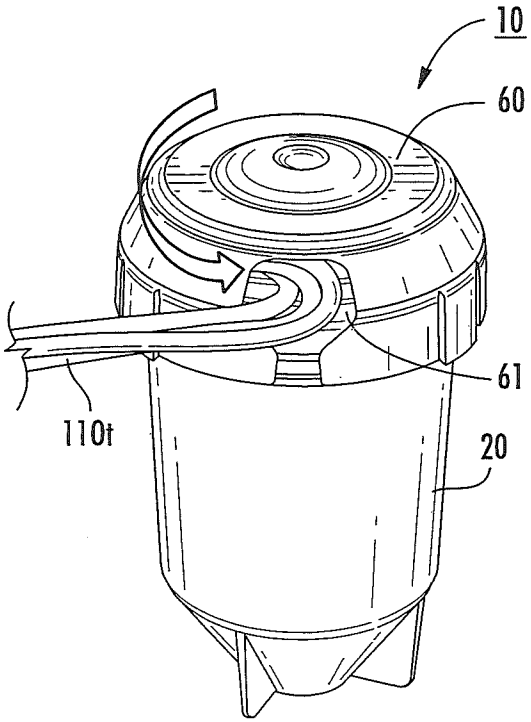

The cap 30 may optionally include conduit brackets 35 that allow lengths of conduit 110 to be wrapped thereabout for storage (FIGS. 12A-12C). The conduit brackets 35 can rise a distance above the top closed surface of the cap and have a "rib-like" support web with an outer concave portion 35*c*. The brackets 35 can be attached via a connecting rib 35*r* and open spaces can reside on each side of the rib 35*r* allowing the conduit 110 from the center port 33 to wrap around the brackets 35. Two concave portions 35*c* of the brackets 35 can circumferentially extend about a common radius and face each other with the fluid port 33 residing therebetween.

Figure 9:
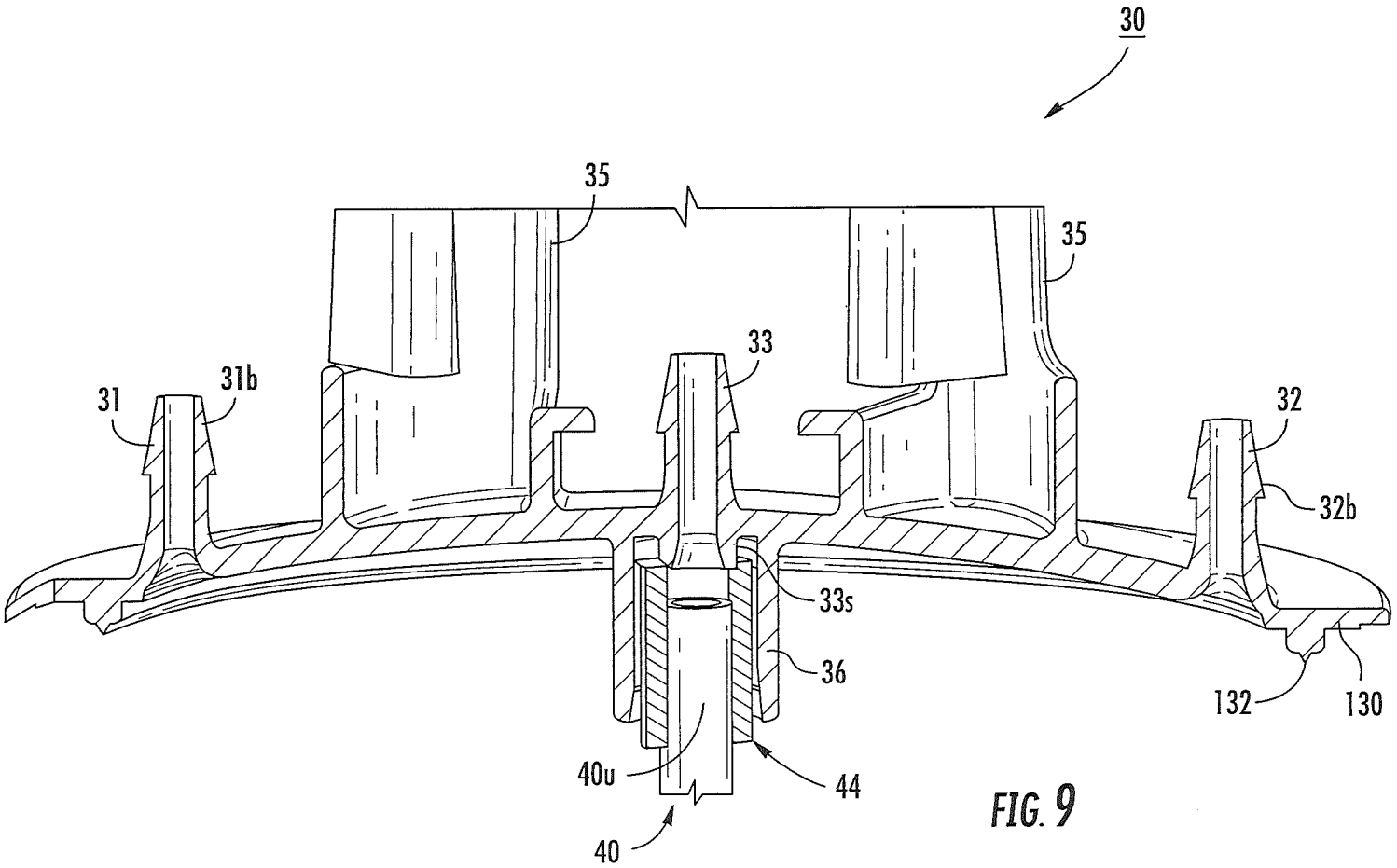
FIG. 9 is an enlarged partial cutaway view of the top portion of the vessel shown in FIG. 1A according to some embodiments of the present invention.

The cap 30 can also be a single-piece injection molded member, typically having a monolithic body that defines the brackets 35, the projecting ports 31, 32, and 33, the circumferentially extending bowl attachment ledge 130 interfacing with a downwardly facing tip 132 (FIG. 9). As with the bowl 20, the moldable material can be any suitable material including, for example thermoplastic polymers including polycarbonates and polypropylenes and may optionally be USP Class VI polycarbonate.

The cap 30 and the bowl 20 can be formed of the same material or different materials. While it is contemplated that the features of the cap 30 and bowl 20 are molded features, some of the features can be attached as separate components to the respective member after molding or be insert molded to the body.

FIGS. 1A, 1B and 3 also illustrate that the bowl bottom portion 20*b* can have a downwardly extending outer wall or sidewalls 20*w* that taper inward as they travel down to a lowermost portion or closed bottom of the bowl 23.

Figure 4:
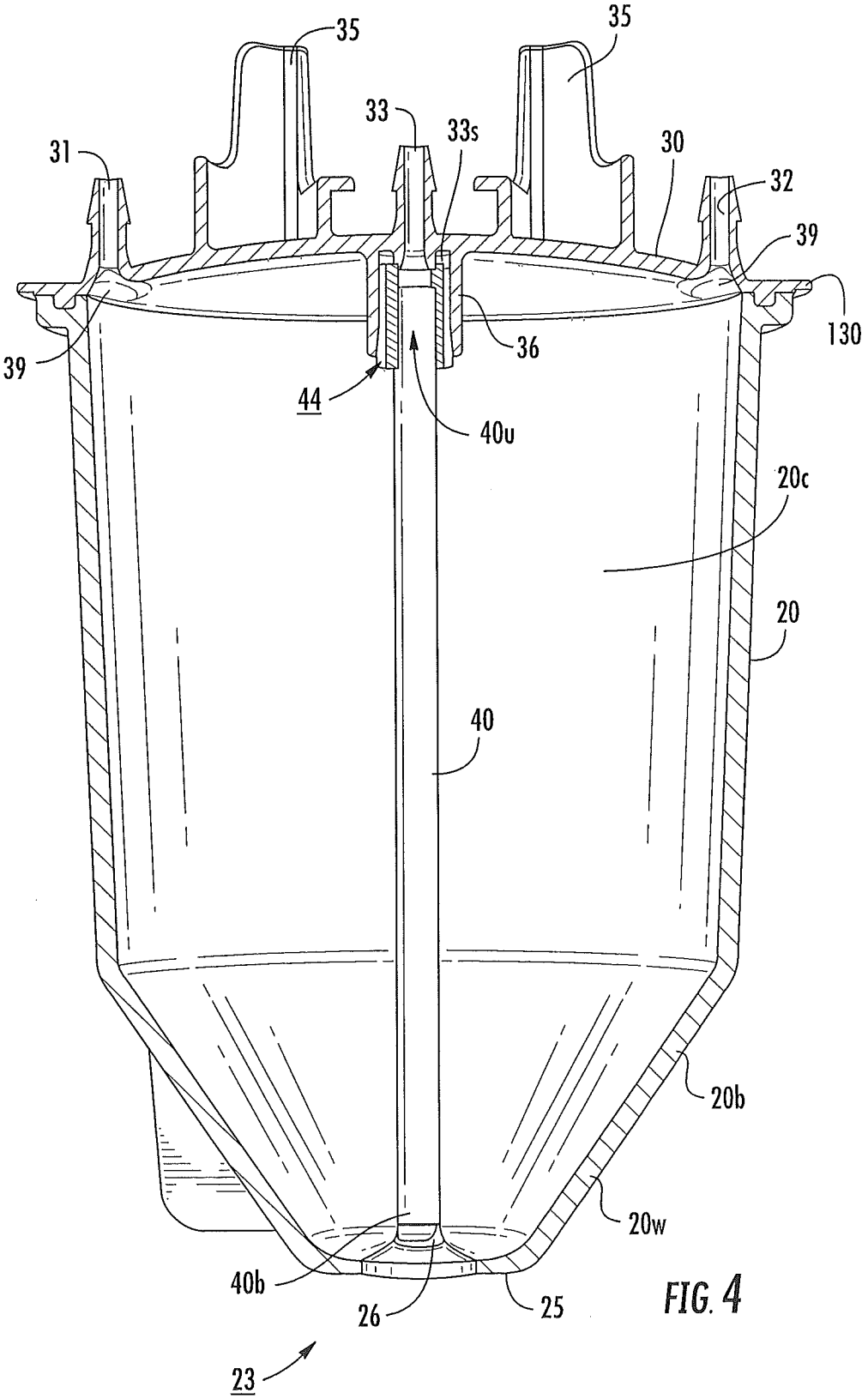
FIG. 4 is a cutaway view of the device shown in FIG. 1A according to embodiments of the present invention.
Figure 6:
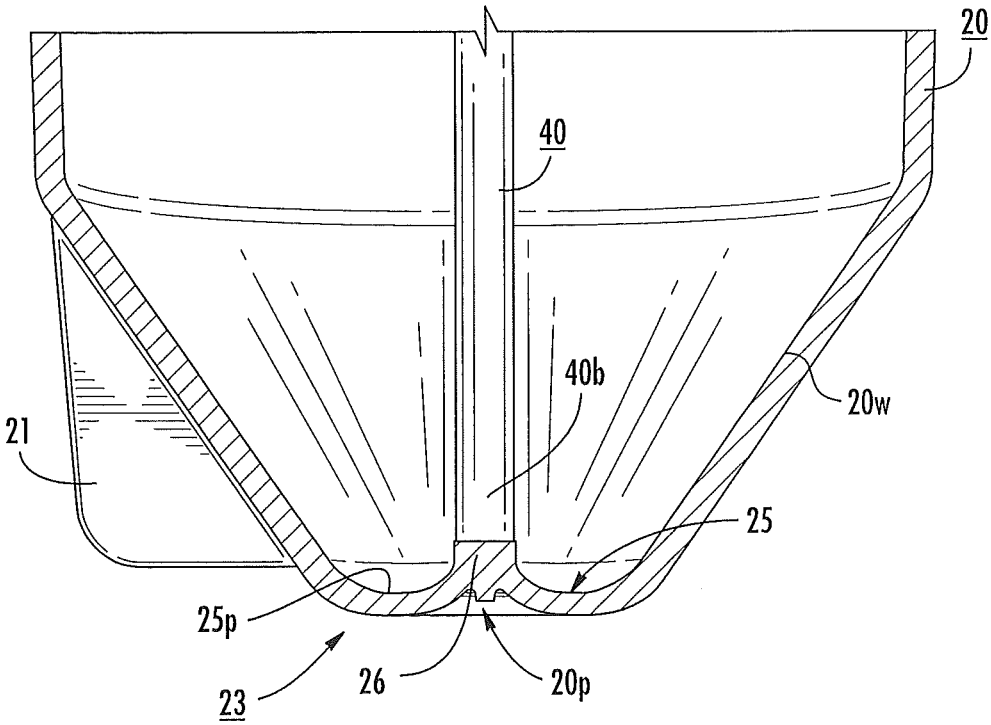
FIG. 6 is an enlarged cutaway view of a lower portion of the vessel shown in FIG. 1A according to embodiments of the present invention.
Figure 8:
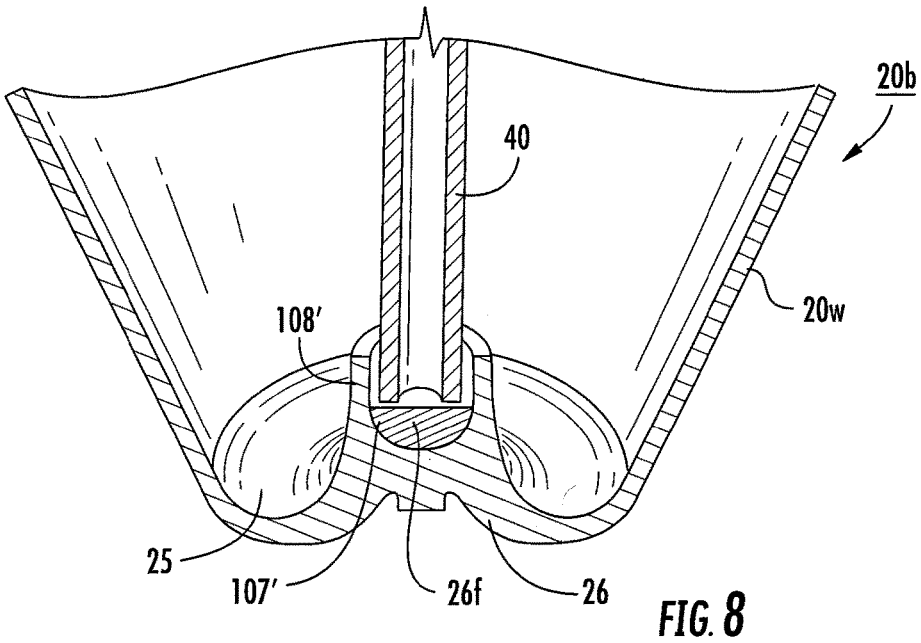
FIG. 8 is a schematic illustration of an alternate embodiment of the tube and bowl interface according to some embodiments of the present invention.
Figure 13C:
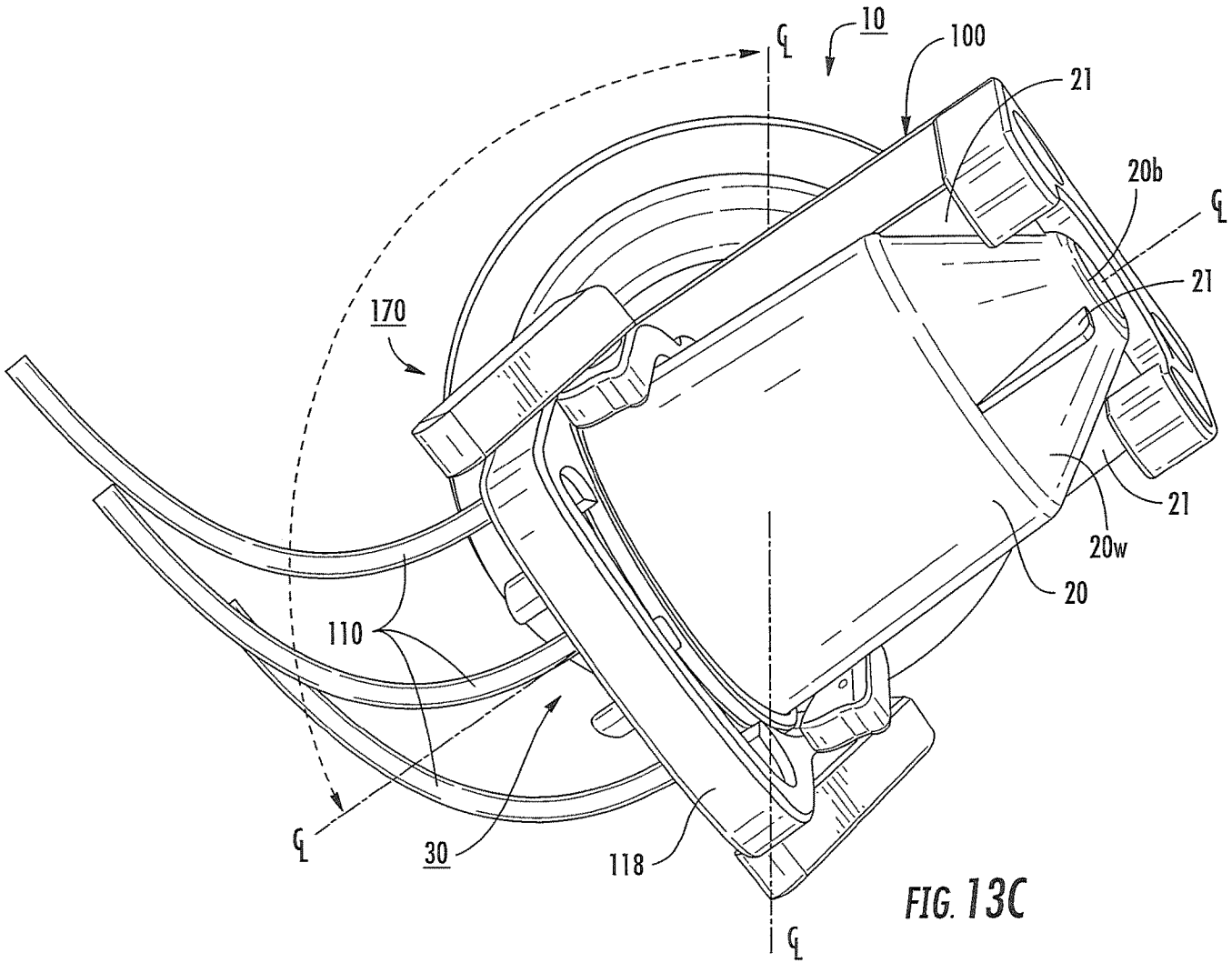
FIG. 13C is a perspective view illustrating the vessel and vessel holder rotated based on movement of the shaker device according to some embodiments of the present invention.

Referring to FIGS. 3, 4 and 6, the bottom 23 can have an annular surface 25 with an inner upwardly facing profile 25*p* that merges into (and surrounds) an upwardly projecting center mound 26. FIG. 6 illustrates that the annular surface 25 can be slightly concave (facing upward) to facilitate a profile-forming annular shape for a soft pellet formation and subsequent re-suspension ("mold" or shape-forming cavity). Thus, as shown in FIG. 6, the bottom of the bowl 23 can be shaped as an annular ring (e.g., an open doughnut) rather than the traditional spherical ended cone. This geometry can allow a soft pellet to form that reduces or minimizes distress to the cells and/or that can support creation of a soft pellet and subsequent re-suspension. Still referring to FIG. 6, the lower tapered walls 20*w* can allow the pellet to be distributed over this surface during re-suspension caused by agitation. The agitation can be carried out electro-mechanically using a "shaker" machine 170 such as shown in FIGS. 13A-13C. Referring to FIGS. 1B and 8, the top portion 20*t* of the bowl 20 can have an outer wall 20*w* that provides a tubular body portion 22 that is wider than the bottom portion 20*b*. The top portion 20*t* of the bowl 20 can have a downwardly extending length with a constant width. The center mound 26 can have a width that is smaller than a width of the annular concave surface 25. An upper end portion of the center mound 108 can extend into the bottom portion of the tube 40*b*. First and second laterally spaced apart shoulders 107, that can be planar as shown, can reside on opposing sides of the center mound 26 beneath the upper end portion of the center mound 108 and abut the bottom of the tube 40*b*.

FIG. 4 illustrates that the bowl 20 and cap 30 enclose a processing chamber 20*c*. The chamber 20*c* is typically sterile and/or aseptic (at least for biologic or live cell processing). The vessel 10 can be used to process a biologic material as defined under Title 21 of the United States Code of Federal Regulations, such as nucleic acid, and/or protein, and so forth, to comply with the regulations and/or guidelines regarding aseptic conditions. Guidelines regarding the preparation of such materials for clinical applications are described in, e.g., U.S. Department of Health and Human Services, *Guidance for Industry: Sterile Drug Products Produced by Aseptic Processing—Current Good Manufacturing Practice* (September 2004). See also, United States Pharmacopeia, United States Pharmacopeia and National Formulary (USP 29-NF 24) (2006), U.S. Department of Health and Human Services, *Guidance for Industry: Sterile Drug Products Produced by Aseptic Processing—Current Good Manufacturing Practice* (September 2004), each of which is incorporated by reference herein in its entirety.

Figure 5:
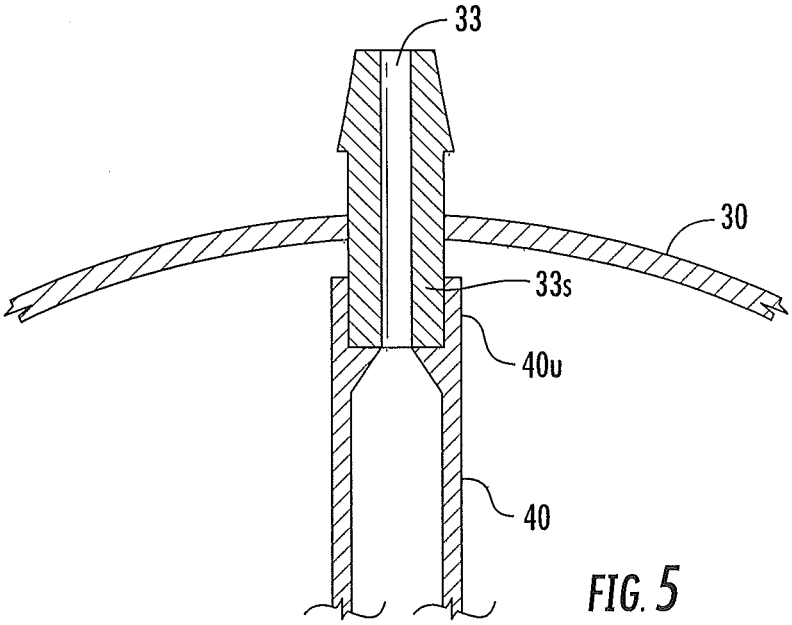
FIG. 5 is a schematic illustration of an alternate embodiment of the cap and tube interface shown in FIG. 4 according to embodiments of the present invention.

Referring again to FIG. 4, the vessel 10 can also include a tube 40 (e.g., a "dip" tube) that is attached to the mound 26 on the bottom of the bowl 20*b* and to the cap 30 to be in fluid communication with fluid port 33. The cap 30 can include a downwardly extending member 36 with a fluid channel that encases an upper portion of the tube 40*u*. A ferrule 44 or other attachment member can facilitate a snug attachment of the upper end of the tube 40, typically a substantially fluid-tight engagement of the tube, with a lower extending stem 33*s* of the fluid port 33. As shown in FIG. 4, the upper end of the ferrule 44 defines a fluid path between the flow port 33 and the tube 40. FIG. 5 illustrates the upper portion of the tube 40*u* can be sized and configured to snugly encase the lower extending stem 33*s* of the fluid port 33 without requiring a ferrule 44 or other intermediate attachment member to secure the tube to cap in alignment with the fluid port 33.

The tube 40 in the vessel 10 can allow the supernatant to be removed with the vessel 10 in an upright condition. Removing the supernatant by drawing (sucking) up the tube 40, typically at a controlled rate using a pump, for example, or other extraction means, can remove the supernatant substantially without losing cells from the pellet as demonstrated by highly consistent cell recoveries. In some embodiments, extraction flow rates of from between about 5 ml/min to about 200 ml/min, including about 50 ml/min may be particularly suitable for soft pellets to facilitate consistent recoveries.

Table 1 (FIG. 16) is a chart that illustrates percent (%) viable cells in waste collected using vessels 10 with the tube 40 using automated runs (e.g., automated system with the controlled motion modes with shaker 170) for two different procedures. This data shows "cell loss" in waste rather than cell recovery which is the opposite, e.g., a 2.2% loss reflects a 97.8% viable cell recovery. Column 1 refers to the experiment number, column 2 shows the % viable cell loss when preparing cells for freezing using the centrifugation vessel 10, while column 3 shows the % viable cell loss when thawing cells and preparing for culture using the centrifugation vessel 10. The mean viable cell loss for each use was below 5%.

Figure 7:
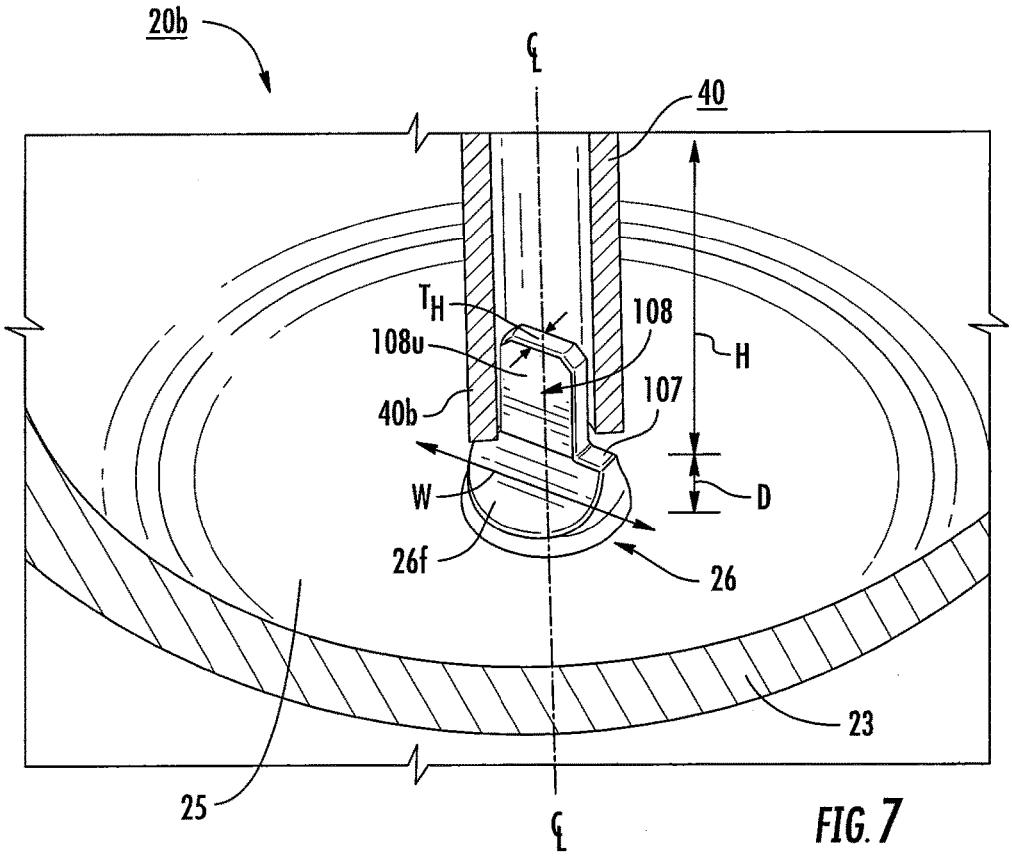
FIG. 7 is an enlarged partial cutaway view of the lower portion of the vessel shown in FIG. 6 according to some embodiments of the present invention.

Referring now to FIG. 7, the bottom of the central tube 40*b* can be held at the center of the vessel 10 by a mound 26. The mound 26 can include elements to control the dip tube position in the vessel 10. As shown in FIG. 7, the mound can include at least one shoulder 107 to control the axial height of the bottom of the dip tube 40*b* a distance above the lowermost base of the well of the bowl 23. Typically, the at least one shoulder 107 is provided as at least two spaced apart shoulders. The mound 26 can also include an upwardly projecting center member 108 (that may be substantially flat such as a "tang") that can be molded into the body of the bowl 20 to retain the tube 40 to be radially centered in-line with a longitudinally extending centerline (marked as C/L) associated with the axis of the bowl. Thus, the mound 26 can comprise an upwardly projecting tang as the center member 108 with a thickness dimension $T_H$ that is less than a width dimension W and a height dimension H and that extends a distance into the bottom of the tube 40*b*. The center member 108 can reside between diametrically opposed shoulders 107. The member 108 may have other configurations including polygonal, cruciform, frustoconical, conical and cylindrical. The center mound 26 can comprise first and second opposing shoulders 107, one residing on opposing sides of the center tang as the center member 108 with a thickness dimension $T_H$ that is less than height H and width W dimensions thereof. The shoulders 107 can have a thickness dimension $T_H$ that is the same as the center tang. The center mound 26 comprises at least one flow clearance surface that tapers down across a width W dimension toward the closed bottom from the shoulders 107 to allow fluid to be extracted from the vessel through the tube during use.

The mound 26 can include at least one sloping surface 26*f* that slopes down from the center member 108 toward the floor of the bowl 23. This at least one sloping surface 26*f* defines a flow clearance feature to allow fluid in the bowl to flow into the tube 40 when the tube 40 is seated on the shoulder features 107. The at least one sloping surface can be provided as two or more surfaces on one or more sides of the mound 26. The tube 40 can be held upright and encased inside the interior chamber 20*c* of the bowl with the bottom portion of the tube 40*b* coupled to the center mound 26 in the bottom of the bowl in a manner that allows fluid to flow into a bottom of the tube 40*b* while coupled to the center mound 26 and the top portion attached to the cap in fluid communication with the fluid port proximate the center of the cap 30.

FIG. 8 illustrates an example of another configuration of the mound 26. In this embodiment, the shoulder 107' is provided as a planar surface and the upwardly projecting member 108' is a ring that is sized and configured to snugly receive the lower end of the tube 40*b*. The shoulder(s) 107, 107' can define a hard stop for the tube to provide a defined height above the lower surface.

In use, having created the soft pellet in the bowl bottom 23, the vessel 10, tube 40 and mound 26 provide a means to remove the supernatant substantially without cell losses from the soft pellet when removing the supernatant. The bottom of the tube 40*b* can reside a defined distance "D" above the inner surface of the bottom of the bowl 23 (FIG. 7). For small volume processing, this distance can be between about 2 mm to about 3 mm.

The tube 40 can be set at a controlled height above the bottom of the bowl 23 by the shoulder 107, 107'. This geometry creates a controlled volume below the bottom of the tube 40*b*. When the supernatant is drawn out of the vessel 10 through the tube 40 (typically at a controlled rate), a consistent residual volume of pellet and supernatant can be created once the tube 40 has drawn up a steady stream of air from the vessel 10. A source of clean gas, such as air, to the vessel 10 can be provided using fluid port 31 or 32 (e.g., hose barbs 31*b*, 32*b*) such as shown in FIG. 9 during supernatant extraction from the bowl by tube 40.

The controlled volume residual at the bottom of the bowl 20*b* facilitates creation of a controlled volume cell suspension by adding a controlled volume of re-suspension fluid in the re-suspension process. A sample drawn from the resulting cell suspension can be used to calculate the total cell population with consistent accuracy. Alternatively, given the minimal loss associated with supernatant removal, the number of cells can be determined prior to centrifugation and used to calculate the amount of re-suspension fluid needed to obtain a desired cell concentration. This is particularly beneficial when it is important to maximize cell recovery and/or when the volume of the total cell suspension is small such as between about 5 ml to about 20 ml. However, the profile of the annular surface can accommodate or be configured to accommodate different volumes to support a wide range of cell populations.

The controlled volume in the bowl provides a controlled pellet volume. Thus, a separate volume measuring step is not required. This is in contrast to processes with uncontrolled pellet volumes, which require the separate volume measurement. This bowl configuration can be particularly important for small volumes where the pellet volume will more strongly impact the calculation. Thus, following supernatant removal, the process can be carried out to avoid a separate volume measurement step after re-suspension.

The mound 26 can be configured to allow robust injection molding tool performance in formation of the bowl 20 and the mound 26 as a single operation. The molding injection point 20*p* illustrated in FIG. 6 can be used so that the details of the tube control mound 26 can be molded reliably. However, in other embodiments, the mound and/or tube alignment and attachment features can be provided by other components that can be attached to the bowl.

Figure 10:
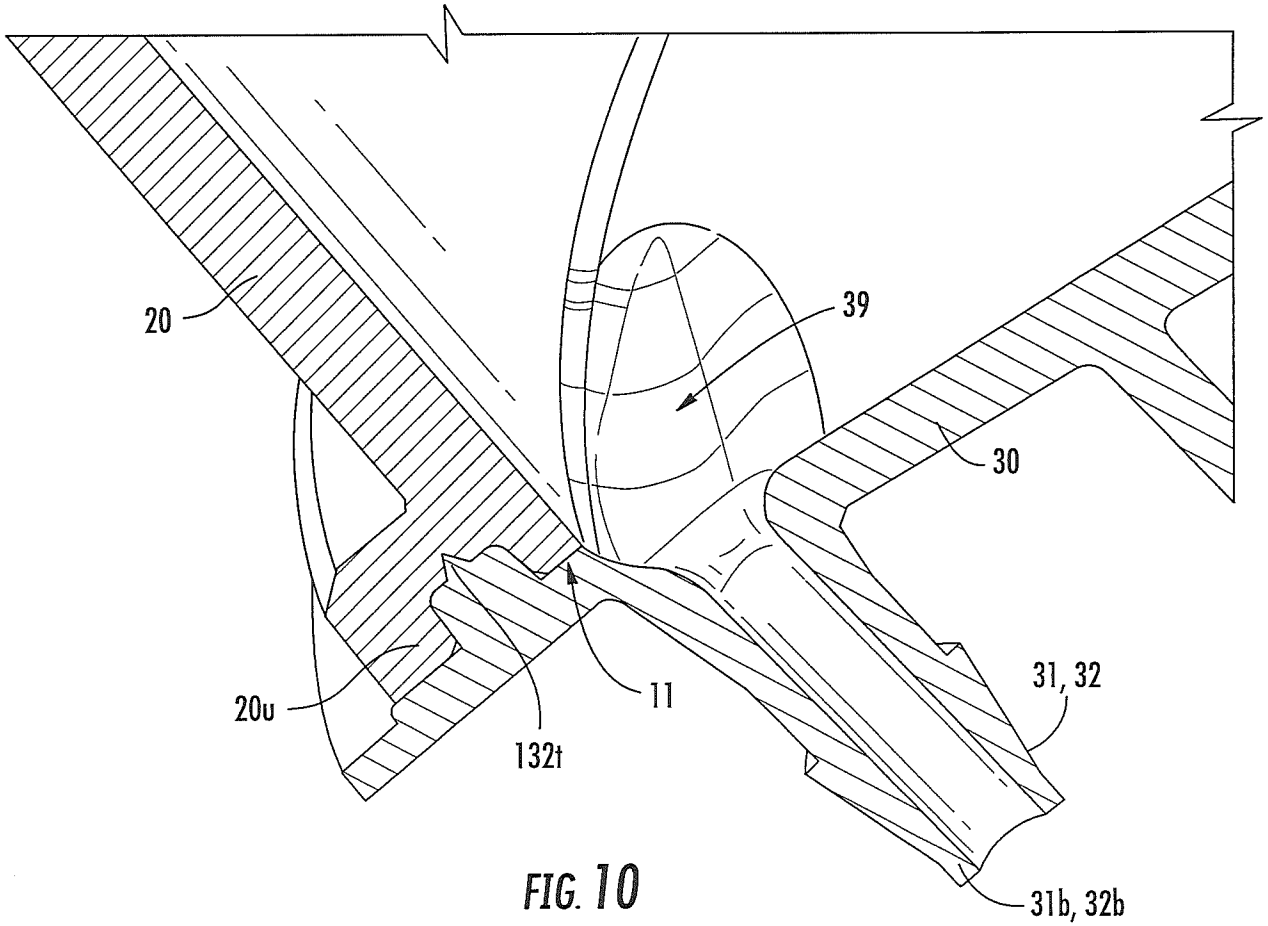
FIG. 10 is an enlarged partial cutaway view of a top portion of the vessel shown in FIG. 1A illustrating a decant feature and cap and bowl interface according to some embodiments of the present invention.

FIG. 10 illustrates that the vessel 10 can include a decanting surface 39 that can allow or facilitate comprehensive recovery of the cell suspension created in the closed vessel. In use, the vessel 10 can be tilted up to drain the cell suspension into one of the two ports 31, 32. When tilted to approximately 135 degrees from vertical, the cell suspension is directed to the decant port 31, 32. The decanter surface 39 can be molded into the cap 30. The decant surface 39 directs internal fluid into the port 31 and/or 32 with minimal residual.

Figure 11B:
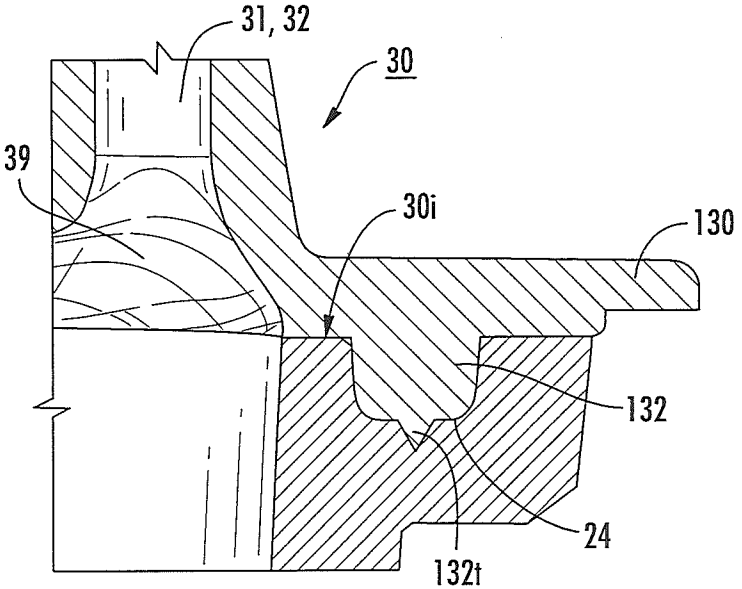
FIGS. 11A and 11B are enlarged partial cutaway views of a cap and bowl interface.

Referring to FIG. 11B, the decanting surface 39 has a rounded smooth inner surface with a concave shape that faces down as the cap transitions from the bowl to the port 31, 32 (when the vessel is upright) and resides at the perimeter interface of the cap and bowl. The decanter surface is configured to reduce losses that may occur at the interfaces between the cap molding and the bowl molding. The decanting surface 39 has a clearance to capture cell suspension that is progressing along the interface line.

Figure 11A:
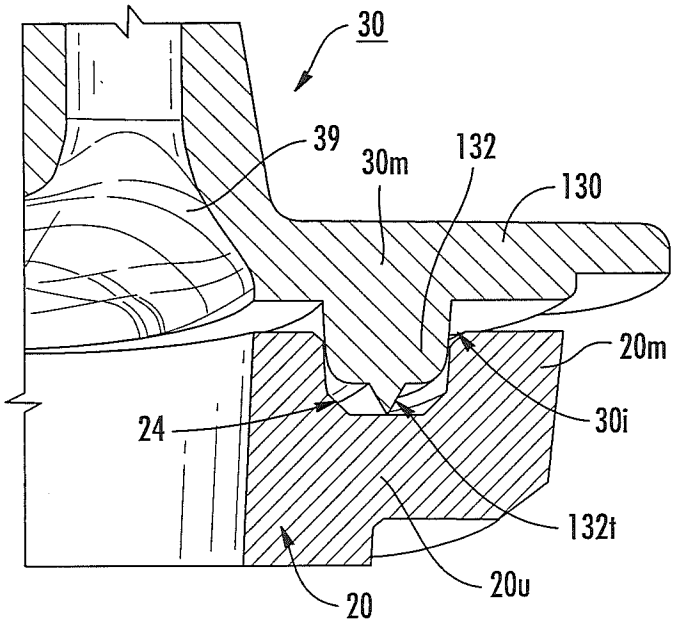

Referring to FIGS. 11A and 11B, in some embodiments, the cap 30 can be attached to the bowl 20 using ultrasonic welding. Other embodiments contemplate other attachment techniques may be used including, for example, bonding, heat staking, brazing or other suitable manner. Ultrasonic welding can be clean and fast and can be monitored to compare each assembly operation to those that have been proven as competent. However, one possible challenge with using ultrasonic welding is a tendency to create small particulates of the parent material that can contaminate the inner surface of the vessel which may be undesirable for some uses. Features of the design have addressed this issue providing for reliable welding function without contamination of the inner vessel. The functionality or success of the decanter feature 39 may also relay on a well managed interface 30*i* between the cap molding 30*m* and the bowl molding 20*m*.

FIG. 11A illustrates that the cap molding 30*m* is presented to the bowl molding 20*m*. The cap molding 30*m* includes a ledge 130 with a profile that has a downwardly extending (ridge) segment 132 with a tip 132*t*. The tip 132*t* provides a weld energy concentration feature. The downwardly extending ridge profile 132 on the cap is designed to engage with a channel 24 of the bowl incorporated in the bowl molding 20*m*. The cap ridge 130 with segment 132 and tip 132*t* and bowl channel 24 are configured so that the ridge 130 is engaged with the channel 24 to inhibit, if not prevent, mold material particle ingress to the bowl 20 when the concentration feature 132*t* contacts the bowl molding 20*m* before welding commences. In the course of the welding process, the welding concentration tip 132*t* is melted and the cap molding 30*m* is compressed towards the bowl molding 20*m*. Displaced material is retained in the channel 24. When the controlled interface 30*i* between the cap molding 30*m* and the bowl molding 20*m* closes, the rate of compression between the two parts suddenly slows, providing tactile feedback that the weld process has achieved a target geometric outcome. The finished bowl assembly at the controlled interface 30*i* is illustrated in FIG. 11B. A pressure test of the completed bowl or visual inspection of the weld "wetted area" can be used to verify weld integrity.

In some embodiments, the vessel 10 can be configured so that the central tube 40 is pressed against the shoulders 107, 107' after welding the cap 30 to the bowl 20, as well as transport and handling. Recognizing that a precision tube length can be difficult to manage and variations in molding dimensions can occur from batch to batch of raw material, the vessel 10 can include features to manage the axial length of the dip tube within the bowl assembly. For example, FIG. 9 illustrates the tube 40 and its interface with the cap 30. During assembly, the upper portion of the tube 40*u* can be pressed into the ferrule 44. The tube 40 and ferrule 44 then define an assembly that can be loaded into the bowl 20 onto the mound 26. The tube 40 to ferrule 44 and the ferrule 44 to cap member 36 joints can each have interference fits. The tube 40 can have an outside diameter that has an interference fit with the inside diameter of the ferrule 44. The tube to ferrule interface can have a tighter interference than the ferrule 44 to the cap feature 36. As the cap 30 is fitted and welded to the upper portion of the bowl 20*u* (FIG. 10), the tube 40 can be pressed against the shoulder(s) 107, 107' and driven into the cap molding 30 with the ferrule 44.

In some embodiments, the vessels can be used to process live cells to form medicaments for human or veterinary uses. In certain embodiments, the vessels 10 can be directed to preparation or manufacture of live cells for drugs and biologics, such as vaccines, and nucleic acids for experimental and/or clinical use. The live cells can include any cell type, including stem/progenitor cells such as CD34+ or CD133+ cells, mesenchymal stem cells, neutrophils, monocytes, lymphoid cells, NK cells, granulocytes, macrophages and other, types of advantageous cells that act as vaccines or other medicaments, for example, antigen presenting cells such as dendritic cells. The dendritic cells may be pulsed with one or more antigens and/or with RNA encoding one or more antigens. Exemplary antigens are tumor-specific or pathogen-specific antigens. Examples of tumor-specific antigens include, but are not limited to, antigens from tumors such as renal cell tumors, melanoma, leukemia, myeloma, breast cancer, prostate cancer, ovarian cancer, lung cancer and bladder cancer. Examples of pathogen-specific antigens include, but are not limited to, antigens specific for HIV or HCV. The live cells can also include stem cells. The cell-based medicaments can be derived based on a patient's own cells or donor cells. In some embodiments, the vessels 10 can be used with blood cells at an early monocyte processing stage.

As is known to those of skill in the art, a centrifuge vessel 10 is normally filled with target material (e.g., live cells), loaded into a centrifuge and spun at a desired speed. The vessel 10 is then removed from the centrifuge for the next processing steps. To access the material in the vessel 10 (which has a functionally closed vessel design) it is common practice to have a tail of tubing 110*t* attached to the vessel 10 that can be sealed off and re-connected to an external tubing system in a sterile way. Sterile connection methods include, for example, TSCD® Sterile Tubing type welders from Terumo Medical Corporation, Somerset, N.J. Sterile disconnection methods include RF sealer devices, in both cases dependent on having compatible, qualified tubing for validated sterile processing.

As shown in FIGS. 12A-12C, in some embodiments, the vessels 10 can be configured with a retention cap 60 that holds the tube tails 110*t* on the top of the cap 30 using brackets 35. These tubes 110 connect the vessel 10 to external processing sources after centrifugation. FIG. 12C illustrates the tubes 110 in broken line so as not to overly occlude the adjacent features of the device.

Different tubes 110, shown as three flexible tubes $\mathbf{110}_1$, $\mathbf{110}_2$, $\mathbf{110}_3$ in FIGS. 13A and 13B, one for each port 31, 32, 33, can be attached to the vessel 10 at one end of each tube. The free lengths of the tubes, e.g., tube tails 110*t*, can be wrapped around the brackets 35 on the cap 30 with loops of the tube tails 110*t* stacked vertically above the cap 30 and extending circumferentially adjacent an outer perimeter of the cap 30 and about the tubing retainer brackets 35 held inside the tube enclosure cap 60. FIGS. 12A-12C illustrate that the cap 60 can be rotated to feed the tube tails into an aperture 61, then into the interior of the cap to wrap the tubing tails 110*t* around the brackets 35. The tails 110*t* can be enclosed in the cap 60. The tube cap 60 can be press-fit to the vessel cap 30 as shown. However, the cap 60 may also be screwed onto threads or otherwise attached (not shown). The vessel can now be placed into the centrifuge bucket and spun with confidence that the tube tails will remain in control.

When the vessel 10 is removed from the centrifuge, the tube tail retainer cap 60 can be removed or flipped open, such as illustrated in FIG. 12C to release the tubing tails 110*t* for attachment to desired process sources or containers using sterile connection technology.

In some embodiments, the vessels 10 can be attached to a centrifuge to concentrate cells in a suspension to create a controlled total volume of the suspension to allow calculation of the total cell population from a cell count of a small sample. This method is commonly used before adding diluting media to achieve a target cell concentration in the suspension. Once the target cell concentration has been achieved, it is then common to transfer the entire contents to a subsequent process step or storage vessels. At these stages of live cell processes, the cell product is often concentrated and valuable. It can be important to recover substantially all, if not the entirety, of the cell suspension. The vessel 10 and/or bowl 20 design can facilitate the recovery of the cell suspension, substantially without residual losses.

As shown in FIGS. 13A-13C, the vessel 10 can also be configured to interact with an automated shaker system 170 for agitation to facilitate re-suspension, mixing functions and/or re-orientation for decanting. Automated manipulation of the vessel 10 using an electro-mechanical holder 100 can facilitate processing, which may be particularly suitable for clinical operations with live cells.

The holder 100 can include a base with slots 101 that releasably engage the orientation members 21. The holder 100 can include a vessel cradle 118 that supports a portion of the vessel 10, shown as an upper portion of the vessel 10. The cradle 118 can include a handle portion 119*h* and a bracket portion 119*b*. The bracket portion 119*b* attaches to the shaker 170. The handle portion 119*h* can pivot to lock and release a respective vessel 10. The handle portion 119*h* can include fingers 119*f* with arcuate inner surfaces 119*a* that snugly engage sides of the outer wall of the bowl 20 of the vessel 10.

While agitation of the bowl 20 can be achieved with standard laboratory devices such as a "Vortex mixer", consistency of the re-suspension process can be greatly increased by automating the shaking action. Following centrifugation and removal of the tube tail cap 60, the vessel 10 can be loaded into the vessel cradle 118. The orientation members 21 of the bowl 20 engage with slots 101 in the base of the holder 100. The vessel clamping handle 119 can be manually or electro-mechanically lifted to lock the vessel 10 into the shaker device 170 as illustrated in FIG. 13B. The shaker device 170 can agitate the vessel 10 in a defined range of motions, coordinating with fluid delivery from one or more sources through one or more ports 31, 32, 33 for example, by an automated control system 150, allowing a highly consistent re-suspension process between different vessels 10. The control system 150 can include an HMI (Human Machine Interface), PLC (Programmable Logic Controller) or other controller that defines the range of motion used to direct the shaker to carry out the sequence, speed and range of motion to process the cells or other material in the vessel 10.

The shaker device 170 can be configured to orient (tilt) the vessel 10 into the decant position using the holder 100 and hold that position. In the decant position, the vessel 10 is partially inverted as illustrated in FIG. 13C. In the decant position/orientation, the centerline of the vessel (marked as C/L), as well as the corresponding (parallel) centerlines of the respective ports 31, 32, 33, can be offset from the upright orientation by between about 90-180 degrees (with the cap 30 facing down), typically between about 120-175 degrees, such as about 135 degrees. While shown as tilted to the left, the vessel 10 can also be tilted to the right or even move from one to another or alternate between the controller inverted tilt positions during the decant operation. In the decant position, the fluid in the vessel 10 is directed to one or more of the ports 31, 32, 33 in the cap 30 for a comprehensive recovery of cell suspension to an external tubing system 110.

Some cells may remain in a surface layer within the vessel 10 once the fluid volume is retrieved by decanting. These residual cells can be recovered with a small volume of flushing media using the agitation to shake the vessel to retrieve the cells into suspension. Using a controlled volume of flushing media as part of a protocol, very high cell recoveries, (the number of cells retrieved versus the number originally in the vessel) can be consistently achieved.

The centrifuge vessel 10 is typically placed into the centrifuge for spinning the pellet down. It is then removed from the centrifuge for further processing of the contents. The vessel 10 can be used with any standard centrifuge. The operating speed can be selected based on media and cell pelletizing parameters. As is well known to those of skill in the art, suspension media density is used for differential buoyancy. The centrifuge speed can change a rate of sedimentation and the hardness of the pellet.

The pellet created in a respective vessel 10 can be easier to re-suspend than pellets formed in traditional centrifuge vessels because a lower speed centrifugation will provide adequate pellet stability for supernatant removal using the tube 40. In some embodiments, the re-suspension process is a progressive activity, starting with agitation of the vessel 10 to break up the pellet and spread the cells around the lower walls 20*w*. A small amount of the target media can then be introduced and the vessel 10 can be agitated to re-suspend the cells. Progressively, more media is introduced and the agitation is modified to a mixing function. Since the volume in the well below the central tube 40 is known, addition of a controlled volume of re-suspension media can deliver a consistent total volume suitable for analysis of the suspension for cell count and other analysis or further processing, including, but not limited to, distribution of cells for freezing, culturing and the like. A controlled volume in the bowl following supernatant removal avoids the need for a separate volume measurement step after re-suspension.

Embodiments of the invention provide a functionally closed centrifuge vessel 10 that can greatly simplify and/or improve live cell processing in a manner that is particularly suitable for small volume products. The vessels 10 can be useful for processing steps just prior to final formulation, fill and finish procedures.

Figure 14:
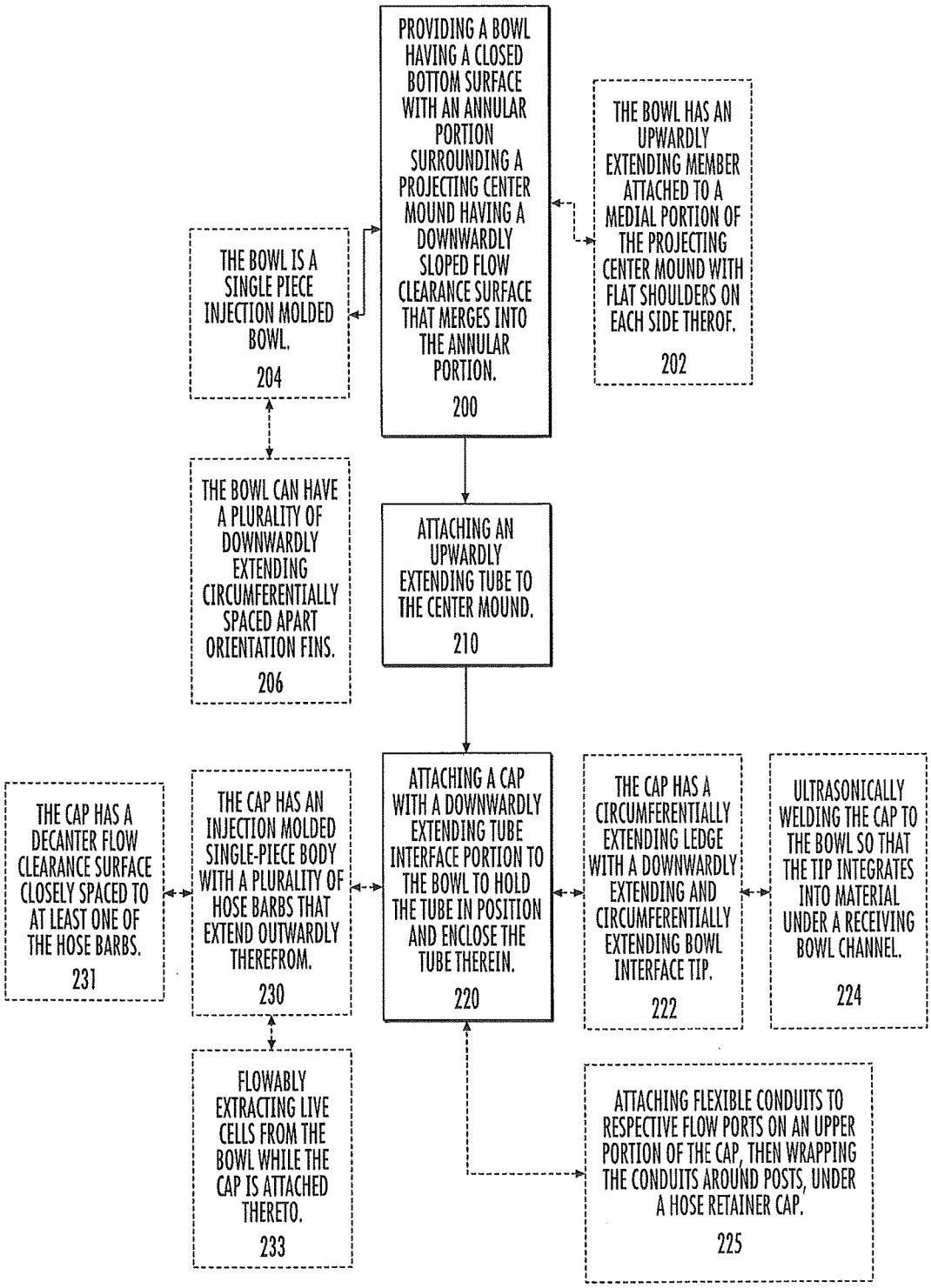
FIG. 14 is a flow chart of operations that can be used to fabricate a centrifuge vessel according to embodiments of the present invention.

FIG. 14 illustrates exemplary operations that can be used to fabricate or assemble vessels according to some embodiments of the present invention. A bowl is provided, the bowl having a closed bottom surface with an annular portion surrounding a projecting center mound having a downwardly sloped flow clearance surface that merges into the annular portion (block 200). An upwardly extending tube is attached to the center mound (block 210). A cap with a downwardly extending tube interface portion is attached to the bowl to hold the tube in position and enclose the tube therein (block 220).

The bowl can have an upwardly extending member attached to a medial portion of the projecting center mound with flat shoulders on each side thereof (block 202). The bowl can optionally be a single piece injection molded bowl (block 204). The bowl can have a plurality of downwardly extending circumferentially spaced apart orientation fins (block 206). The cap can have an injection molded single-piece body with a plurality of hose barbs that extend outwardly therefrom (block 230). Live cells can be flowably extracted from the bowl while the cap is attached thereto (block 233). The cap can have a decanter flow clearance surface closely spaced to at least one of the hose barbs (block 231). The cap can have a circumferentially extending ledge with a downwardly extending and circumferentially extending bowl interface tip (block 222). The cap can be ultrasonically welded to the bowl so that the tip integrates into material under a receiving bowl channel (block 224). Flexible conduits can be attached to respective flow ports on an upper portion of the cap, then the conduits can be wrapped around posts under a hose retainer cap (block 225).

Figure 15:
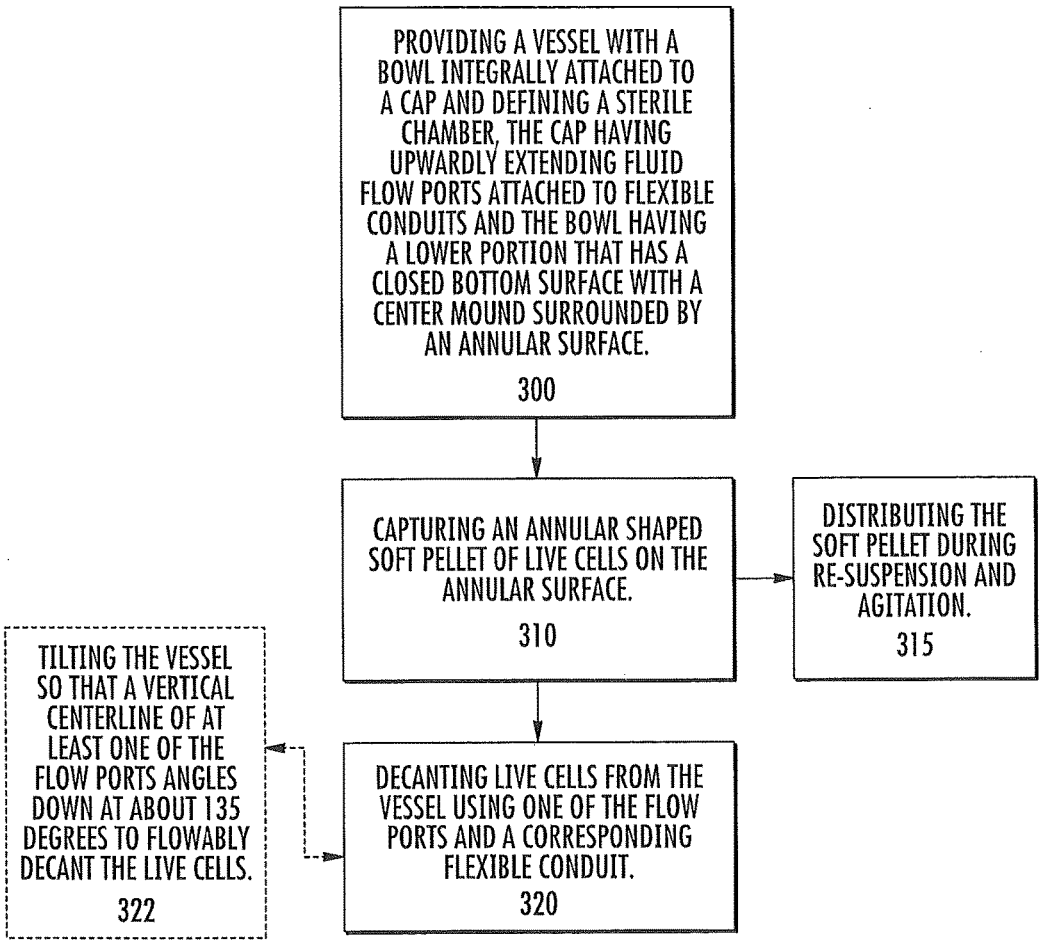
FIG. 15 is a flow chart of exemplary operations that can be used to process biologic material, such as live cells, according to embodiments of the present invention.

FIG. 15 illustrates exemplary operations that can be used to process live cells according to embodiments of the present invention. A vessel with a bowl integrally attached to a cap and defining a sterile internal chamber is provided, the cap having upwardly extending fluid flow ports attached to flexible conduits and the bowl having a lower portion that has a closed bottom surface with a center mound surrounded by an annular surface (block 300). An annular shaped soft pellet of live cells can be captured (formed) on the annular surface (in response to rotating the vessel using a centrifuge) (block 310). Live cells can be decanted from the vessel using one (or more, but typically one) of the flow ports and a corresponding flexible conduit (block 320). The vessel can be tilted so that a vertical centerline of at least one of the flow ports angles down at about 135 degrees to flowably decant the live cells (block 322). The soft pellet can be redistributed during re-suspension and/or agitation (after the centrifuge operation) (block 315) before the decanting step. The agitation and/or mixing can be carried out automatically using a control system and a holder attached to a shaker device.

The foregoing is illustrative of embodiments of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed:

1. A centrifuge vessel, comprising:

a bowl having a bottom portion and a top portion, the bottom portion having a downwardly extending outer wall that tapers inwardly from the top portion to merge into a closed bottom, the closed bottom having an internal annular concave surface surrounding a center mound;

a cap configured to attach to the bowl to define an enclosed interior chamber, the cap comprising a plurality of spaced apart upwardly extending fluid ports, one residing proximate a center of the cap; and an elongate tube having a length with opposing top and bottom portions and an open flow channel extending therethrough, the tube held upright and encased inside the interior chamber with the bottom portion coupled to the center mound in the bottom of the bowl in a manner that allows fluid to flow into a bottom of the tube while coupled to the center mound, and wherein the top portion of the tube is attached to the cap and is in fluid communication with the fluid port proximate the center of the cap, wherein the center mound comprises at least one shoulder that provides a stop for the tube so that a bottom surface of the bottom portion of the tube engages the shoulder and resides proximate but a defined distance above the closed bottom of the bowl.

2. The vessel of claim 1, wherein the cap includes external tubing retainer brackets extending upwardly thereon, wherein the top portion of the bowl has an outer wall that provides a tubular body portion that is wider than the bottom portion, wherein the center mound has a width that is smaller than a width of the annular concave surface, wherein an upper end portion of the center mound extends into the bottom portion of the tube, and wherein the at least one shoulder is provided as first and second laterally spaced apart shoulders that reside on opposing sides of the center mound beneath the upper end portion of the center mound and abut the bottom of the tube.

3. The vessel of claim 2, further comprising a tube enclosure cap attached to the cap, wherein the tube enclosure cap is configured to enclose a plurality of tube tails with stacked loops of the tube tails with the loops stacked vertically above the cap and extending circumferentially adjacent an outer perimeter of the cap and about the tubing retainer brackets held inside the tube enclosure cap.

4. The vessel of claim 1, wherein the cap comprises an internal decanting surface with a concave shape that faces the bowl and resides proximate an outer perimeter portion of the cap adjacent at least one of the fluid ports.

5. The vessel of claim 1, wherein the cap comprises a ledge extending about a lower perimeter portion thereof, the ledge having a profile with a downwardly extending ridge portion that is integrally attached to a channel that extends about an upper end of the bowl.

6. The vessel of claim 1, wherein the at least one shoulder is provided as at least one planar shoulder.

7. A centrifuge vessel, comprising:

a bowl having a bottom portion and a top portion, the bottom portion having a downwardly extending outer wall that tapers inwardly from the top portion to merge into a closed bottom, the closed bottom having an internal annular concave surface surrounding a center mound;

a cap configured to attach to the bowl to define an enclosed interior chamber, the cap comprising a plurality of spaced apart upwardly extending fluid ports, one residing proximate a center of the cap; and an elongate tube having a length with opposing top and bottom portions and an open flow channel extending therethrough, the tube held upright and encased inside the interior chamber with the bottom portion coupled to the center mound in the bottom of the bowl in a manner that allows fluid to flow into a bottom of the tube while coupled to the center mound, and wherein the top portion of the tube is attached to the cap and is in fluid communication with the fluid port proximate the center of the cap, wherein the center mound comprises an upwardly projecting tang with a thickness dimension that is less than a width dimension and a height dimension that extends a distance into the bottom of the tube.

8. The vessel of claim 1, wherein the center mound defines a flow surface that tapers down to the closed bottom of the bowl from the at least one shoulder.

9. A centrifuge vessel, comprising:

a bowl having a bottom portion and a top portion, the bottom portion having a downwardly extending outer wall that tapers inwardly from the top portion to merge into a closed bottom, the closed bottom having an internal annular concave surface surrounding a center mound;

a cap configured to attach to the bowl to define an enclosed interior chamber, the cap comprising a plurality of spaced apart upwardly extending fluid ports, one residing proximate a center of the cap; and an elongate tube having a length with opposing top and bottom portions and an open flow channel extending therethrough, the tube held upright and encased inside the interior chamber with the bottom portion coupled to the center mound in the bottom of the bowl in a manner that allows fluid to flow into a bottom of the tube while coupled to the center mound, and wherein the top portion of the tube is attached to the cap and is in fluid communication with the fluid port proximate the center of the cap, wherein the center mound comprises first and second opposing shoulders, one residing on opposing sides of a center tang with a thickness dimension that is less than height and width dimensions thereof, wherein the shoulders have a thickness dimension that is the same as the center tang, and wherein the center mound comprises at least one flow clearance surface that tapers down across a width dimension of the center mound toward the closed bottom from the shoulders to allow fluid to be extracted from the vessel through the tube during use.

10. A processing system comprising the centrifuge vessel of claim 1 and a holder having a vessel cradle and a base, wherein the holder vessel cradle releasably engages the vessel so that the bottom of the bowl is held in the base with external orientation and/or locking members held in slots of the base, wherein the vessel cradle is attached to a shaker device that rotates the vessel through a defined sequence of movement, and wherein the defined sequence of movement has rotational motions that are less than 360 degrees to serially tilt the centrifuge vessel and orient the cap both below and above the bottom of the bowl.

11. The system of claim 10, further comprising a controller in communication with the shaker device that directs the shaker device to vibrate and/or shake the vessel and rotate to carry out the defined sequence of movement, then the controller directs the shaker to translate to a decant orientation where the holder and shaker device cooperate to hold the vessel tilted to be partially inverted.

12. The vessel of claim 1, further comprising live cells therein, wherein the cap has a perimeter portion with a circumferentially extending ledge that is ultrasonically welded to an upper end of the bowl to define a fluid-tight perimeter such that fluid can enter and/or exit only through the fluid ports, wherein the vessel defines a functionally closed sterile processing system with the live cells therein, and wherein the bowl comprises outwardly extending orientation and/or locking members that extend radially outward and are circumferentially spaced apart and terminate above an outer bottom surface of the bowl at a location where a diameter of the bowl increases from the bottom portion to a maximal width below the top portion of the bowl.

13. A method of processing live cells, comprising: providing the centrifuge vessel of claim 1, the vessel comprising live cells for processing; centrifuging the live cells in the vessel; capturing the live cells as a soft pellet in an annular shape in the bottom of the bowl; and then removing supernatant in the vessel through the tube and then through the fluid port of the cap.

14. The method of claim 13, further comprising attaching ends of flexible conduit to respective fluid ports on the cap so that the conduits have free tails, then wrapping the conduit tails in loops about brackets on the cap before the centrifuging step.

15. The method of claim 14, further comprising unwrapping the conduit tails and connecting the tails to target devices after the centrifuging step.

16. The method of claim 13, further comprising:

mounting the vessel to an automated shaker;

electronically directing the automated shaker to carry out a defined sequence of movement; and redistributing or re-suspending the live cells in the soft pellet in response to the directing step to thereby vibrate, shake and/or mix the cells using the automated shaker.

17. The method of claim 16, wherein the mounting is carried out using a mechanical holder that is attached to the shaker, the holder also having a vessel cradle that releaseably engages the vessel, the method further comprising electronically directing the shaker to stop at a position that causes the holder to tilt the vessel to a partially inverted position, then decanting fluid in the vessel through at least one fluid port into a respective flexible conduit.

18. A centrifuge vessel, comprising:

a bowl having a bottom portion and a top portion, the bottom portion having a downwardly extending outer wall that merges into a closed bottom, the closed bottom having an annular surface surrounding a center mound, wherein the downwardly extending outer wall of the bottom portion tapers inwardly so that the bowl has a smaller width at the closed bottom than at the top portion;

a cap attached to the bowl to define an enclosed interior chamber, the cap comprising a plurality of spaced apart upwardly extending fluid ports, one residing proximate a center of the cap; and an elongate internal tube having a length with opposing top and bottom portions and an open flow channel extending therethrough, the elongate internal tube held upright and encased inside the interior chamber with an upper end portion of the center mound extending into the bottom portion of the tube and the top portion of the elongate tube attached to the cap and in fluid communication with the fluid port proximate the center of the cap, wherein the upper end portion of the center mound is vertically oriented and planar with a width and height dimension greater than a thickness dimension, wherein the center mound has a shoulder which extends radially outward a distance beyond a width of the upper end portion, wherein the upper end portion of the center mound merges into a flow surface that extends across the width of center mound below the shoulder and tapers outwardly toward the outer wall in a downward direction to the closed bottom of the bowl with the bottom portion, and wherein the center mound and a bottom of the tube are cooperatively coupled to allow fluid to flow into the bottom of the tube while the tube is coupled to the center mound.

19. The vessel of claim 18, wherein the top portion of the bowl has a downwardly extending length with a constant width, wherein the cap includes upwardly extending external tubing retainer brackets on an outer perimeter portion of an upper surface of the cap, and wherein the cap comprises an internal decanting surface with a concave shape that faces the bowl and resides proximate an outer perimeter portion of the cap adjacent at least one of the fluid ports.

20. The vessel of claim 19, further comprising an upper tube enclosure cap attached to the cap of the vessel, wherein the tube enclosure cap encloses a plurality of tube tails with stacked loops of the tube tails extending about the tubing retainer brackets held inside the tube enclosure cap, and wherein the loops are stacked vertically above the cap and extend circumferentially adjacent an outer perimeter of the cap held by the tubing retainer brackets.

21. The vessel of claim 18, wherein the top portion of the bowl has an outer downwardly extending wall that merges into the outer downwardly extending wall of the bottom portion and that provides a tubular body portion, wherein the tubular body portion of the top portion of the bowl has a greater width than the bottom portion of the bowl and has a greater downwardly extending length than the bottom portion of the bowl, wherein the center mound has a width that is smaller than a width of the annular concave surface, and wherein the shoulder comprises first and second laterally spaced apart shoulders that reside on opposing sides of the center mound beneath the upper end portion of the center mound, abut a bottom surface of the bottom portion of the tube and hold the bottom of the tube a distance in a range of about 2 mm to about 3 mm above the closed bottom of the bowl.

* * * * *